US008794510B2

(12) United States Patent
Buchmann et al.

(10) Patent No.: US 8,794,510 B2
(45) Date of Patent: Aug. 5, 2014

(54) METHOD FOR PROCESSING BANKNOTES

(75) Inventors: Klaus Buchmann, Munich (DE); Alfred Schmidt, Munich (DE); Frank Werner, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 282 days.

(21) Appl. No.: 13/386,200

(22) PCT Filed: Jul. 20, 2010

(86) PCT No.: PCT/EP2010/060476

§ 371 (c)(1),
(2), (4) Date: Apr. 10, 2012

(87) PCT Pub. No.: WO2011/009856

PCT Pub. Date: Jan. 27, 2011

(65) Prior Publication Data

US 2012/0197433 A1 Aug. 2, 2012

(30) Foreign Application Priority Data

Jul. 22, 2009 (DE) ..... 10 2009 034 065

(51) Int. Cl.
*G07F 19/00* (2006.01)
*G07D 11/00* (2006.01)

(52) U.S. Cl.
CPC ..... *G70D 11/0084* (2013.01); *G07D 11/006* (2013.01)
USPC ..... 235/379

(58) Field of Classification Search
CPC ..... G07D 11/0084; G07D 7/00; G07D 7/20; G07D 7/0033; G07F 19/00; G07F 19/202; G06Q 20/1085
USPC ..... 235/379
See application file for complete search history.

(56) References Cited

U.S. PATENT DOCUMENTS

RE38,663 E 11/2004 Kayani et al.
7,380,675 B2 * 6/2008 Gubbey et al. ..... 209/534

(Continued)

FOREIGN PATENT DOCUMENTS

DE 10030221 A1 1/2002

(Continued)

OTHER PUBLICATIONS

ISR in PCT/EP2010/060476, Aug. 30, 2010.

(Continued)

*Primary Examiner* — Kristy A Haupt
(74) *Attorney, Agent, or Firm* — Workman Nydegger

(57) ABSTRACT

A method in which accounting units consisting of one or several bank notes are successively processed by a processing machine, wherein the bank notes are checked by a sensor device and a control device. One or several accounting units are inserted, the information items characterizing the accounting units are entered, the bank notes of each accounting unit are singled, checked, and in dependence on the check are assigned to output units of the processing machine The bank notes recognized upon the check are accounted for the respective accounting unit by the control device and transported into the assigned output unit. Bank notes not recognized upon the check are divided into two groups with a first group containing the unrecognized individual bank notes for which an identification feature characterizing the respective bank note can be ascertained by sensor device and control device, and a second group whose respective identification feature cannot be ascertained by the sensor device and control device.

11 Claims, 4 Drawing Sheets

(56) References Cited

U.S. PATENT DOCUMENTS

| | | | | |
|---|---|---|---|---|
| 2004/0007509 | A1 | 1/2004 | Gubbey et al. | |
| 2004/0024663 | A1 | 2/2004 | Humpisch et al. | |
| 2004/0211829 | A1* | 10/2004 | Steinkogler et al. | 235/379 |
| 2009/0001157 | A1 | 1/2009 | Buntscheck et al. | |
| 2010/0092065 | A1* | 4/2010 | Jones et al. | 382/135 |

FOREIGN PATENT DOCUMENTS

| | | | |
|---|---|---|---|
| DE | 10030227 | | 2/2002 |
| DE | 10049433 | | 4/2002 |
| DE | 10050486 | A1 | 4/2002 |
| DE | 102004049209 | A1 | 4/2006 |
| WO | 2009013465 | | 1/2009 |
| WO | 2009019410 | | 2/2009 |

OTHER PUBLICATIONS

Examination Report of German Patent & Trademark Office regarding DE 10 2009 034 065.3 of Jul. 16, 2010.

* cited by examiner

METHOD FOR PROCESSING BANKNOTES

BACKGROUND OF THE INVENTION

1. Field of the Invention

The present invention relates to a method for processing bank notes, in which bank notes coming from different deposits are successively processed.

2. Related Art

When handling a large number of bank notes from various deposits by means of a bank note processing machine, there arises the problem that not always all bank notes can be automatically processed by the bank note processing machine and assigned to the respective deposit, because for example bank notes are not recognized or it comes to other processing problems in the bank note processing machine, e.g. double or multiple picks upon the singling of the bank notes to be processed, which impede the automatic processing, i.e. unequivocal identification and evaluation. The resulting bank notes require a manual post-processing which usually is very elaborate. In addition, during the post-processing it must be ensured that these bank notes are always assigned to that deposit from which they originally come from, so that a correct accounting of the individual deposits can be effected.

From U.S. RE38663 E it is for example known to separate various deposits, each having several bank notes, by means of separator cards. The separator cards are inserted between the various deposits in order to separate these. The separator cards here can be arranged at the beginning, at the end or at the beginning and at the end of the group of bank notes forming the respective deposit. The separator cards may contain information items for example about the depositor and/or about the deposit. Furthermore, the separator cards are configured such that upon processing they are automatically recognized by the bank note processing machine. If a separator card is recognized, the bank note processing machine can record the recognized bank notes for the assigned deposit or for the corresponding depositor and credit an account therewith. Bank notes which could not be recognized upon the automatic processing with the bank note processing machine or do not meet specified criteria, however, cannot be accounted, so that they are rejected and together with the respective separator card are stored in an output unit. When post-processing these bank notes, it is possible to assign the respective bank notes to the associated deposit by means of the information items of the respective separator card.

With this procedure there may arise a great effort in post-processing the rejected bank notes, if a large number of bank notes cannot be automatically recognized and accounted.

In DE 100 30 227 A1 it was therefore proposed that the rejected bank notes are further divided into groups, whereby at least the bank notes of one of these groups can be recognized in principle upon the processing in the bank note processing machine, so that these bank notes can be at least provisionally accounted and credited to the depositor. Bank notes recognized in principle can be forgeries, bank notes suspected to be forgeries or bank notes which have a wrong position, i.e. which, for example, do not lie with their front facing upwards, as desired, but with their back. That is, bank notes for which the currency and face value could be recognized, so that at least a provisional accounting can be effected. It is additionally proposed to store unequivocal features of the bank notes recognized in principle, for example, their serial numbers, in order to make it possible for the bank notes to be assigned later to the respective deposit on the basis of the unequivocal features.

The solution proposed in DE 100 30 227 A1, however, has turned out to be problematic, because the in-principle recognition of the bank notes necessary therefor, i.e. the recognition of currency and face value, makes relatively high demands, so that only a certain portion of the rejected bank notes of the group of bank notes recognized in principle can be assigned, which at least can be provisionally accounted.

SUMMARY OF THE DISCLOSURE

It is therefore the object of the present invention to state a method for processing bank notes, in which bank notes associated to various accounting units are successively processed, in which the effort required for a post-processing of bank notes to be rejected, and thus not automatically processable, is reduced. This is to make possible in particular a more complete provisional accounting of the bank notes to be rejected, i.e. as many bank notes to be basically rejected as possible are to be provisionally accounted for or at least assigned to the respective accounting unit.

The invention is based on a method for processing bank notes in which accounting units consisting of one or several bank notes are successively processed by means of a processing machine, whereby the bank notes are checked by means of a sensor device and a control device. For this purpose, one or several accounting units are inserted, the information items characterizing the accounting units are entered, the bank notes of each accounting unit are singled, checked, and in dependence on the check are assigned to output units of the processing machine. According to the invention, the bank notes recognized upon the check are accounted for the respective accounting unit by the control device and transported into the assigned output unit. Bank notes not recognized upon the check are divided into two groups by the control device, whereby a first group contains the individual bank notes not recognized upon the check for which an identification feature characterizing the respective bank note can be ascertained by sensor device and control device, whereas a second group contains the bank notes not recognized upon the check whose respective identification feature cannot be ascertained by sensor device and control device. Bank notes of the first and second group are transported into different output units, and the control device assigns the ascertained identification features of the bank notes of the first group to the respective accounting unit.

The advantage of the invention is to be seen in particular in the fact that the recognition of an identification feature, in particular of a serial number, makes relatively low demands on the processing in the processing machine. Each individually present bank note to be rejected can thus be at least provisionally accounted or at least be assigned to the respective accounting unit, if at least the serial number is recognized. The reduced demands make it possible that a substantially larger portion of bank notes to be basically rejected can be provisionally accounted or assigned. On the one hand, the result of the provisional accounting thus corresponds better with the final accounting after a subsequent check. On the other hand, the effort for the subsequent check is reduced, since substantially more bank notes have already been provisionally accounted or assigned. In addition, the number of bank notes to be subsequently checked manually can be further reduced by it being possible for the provisionally accounted bank notes to be checked again by the processing machine in further runs and recognized by the processing machine as unequivocally authentic and belonging to a certain denomination or face value. The unequivocally recognized bank notes can then be automatically processed by the processing machine according to the specifications.

BRIEF DESCRIPTION OF THE DRAWINGS

Further advantages of the present invention appear from the dependent claims and the following description of an embodiment with reference to Figures, in which:

DETAILED DESCRIPTION OF PREFERRED EMBODIMENTS OF THE INVENTION

In the following description, the term accounting unit is used for one or several bank notes to be accounted, which are to be assigned to a certain person (depositor) or to a certain account.

Figure 1:
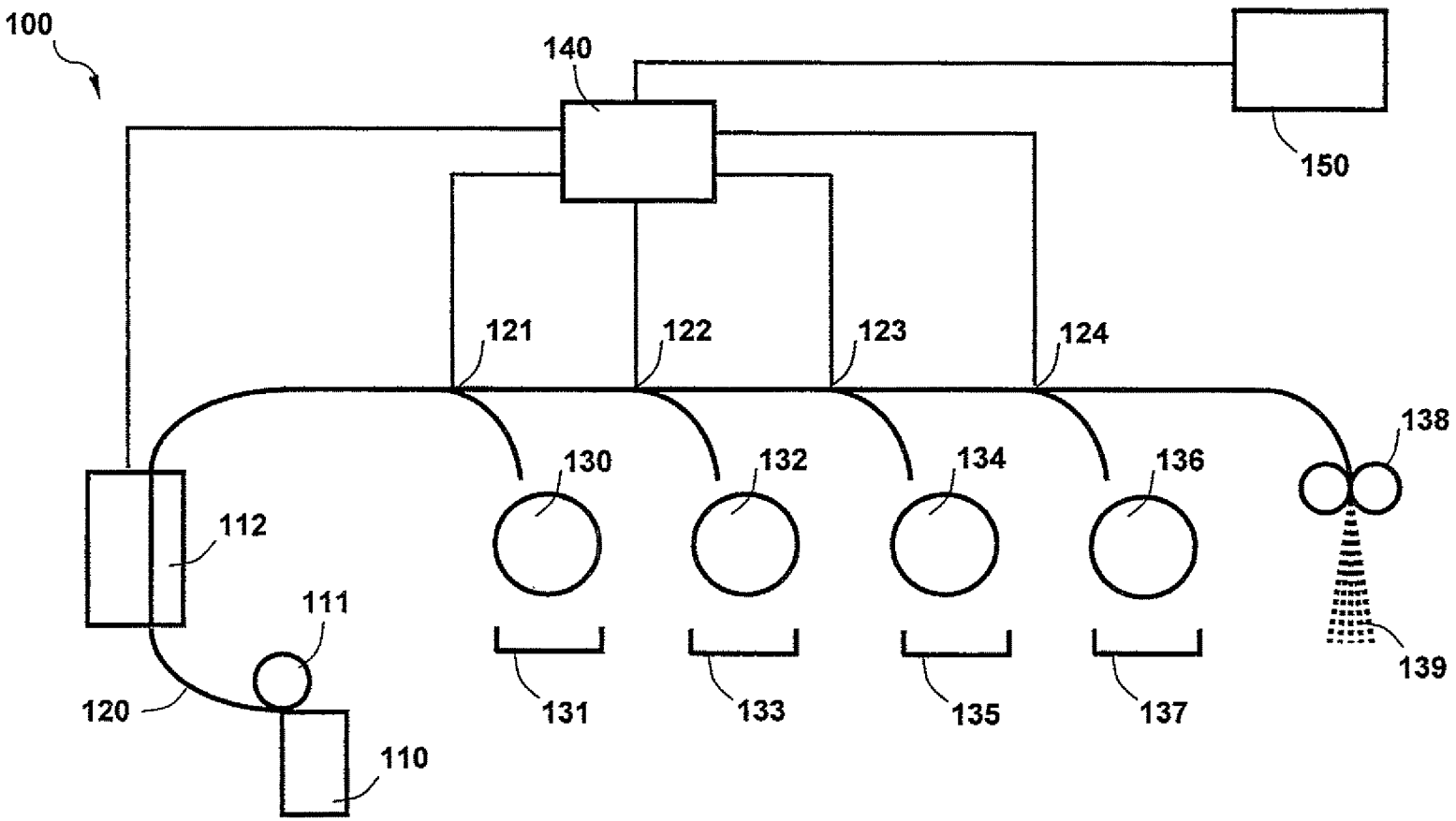
FIG. 1 shows a basic structure of a processing machine for processing accounting units consisting of bank notes.

In FIG. 1 there is represented a basic structure of a processing machine 100 for processing bank notes or accounting units consisting of a certain number of bank notes. The processing machine 100 has an input unit 110 into which are inserted one or several accounting units. The different accounting units can be successively inserted by an operator, whereby the operator can provide information items about the accounting units, e.g. a reference number of the accounting unit, an account number etc, by means of an input/output unit 150, e.g. a touch screen. The accounting units, however, can also be separated from each other by means of separator cards and be jointly inserted. The separator cards may contain information items about the respective accounting unit, e.g. a reference number of the accounting unit, an account number, etc. It is further possible that the accounting units are banded bundles of bank notes. In this case, the information items can be contained in the bands of the bank note bundles. This information items can be automatically captured or be entered by the operator, in order to characterize the respective accounting unit. Before the bank notes or accounting units are inserted into the input unit 110, the band is removed automatically or by the operator.

The input unit 110 is connected to a singler 111, which removes the individual bank notes of the accounting units and, if present, the separator cards from the input unit 110 and transfers them to a transport system 120. The transport system 120 transports the individual bank notes and separator cards through a sensor device 112 which ascertains data of the bank notes which for example make possible conclusions about authenticity, state, face value etc. Furthermore, in the sensor device 112 the separator cards can be recognized, and information items contained on the separator card can be captured by the sensor device 112. The ascertained data of the bank notes and the captured information items of the separator cards are transferred to a control device 140 which evaluates the data and information items and thus controls the further flow of the bank notes or separator cards through the processing machine 100. For this purpose, the control device 140 acts upon diverters 121 to 124 which are components of the transport system 120 and allow the bank notes or separator cards to be stored in output units 130 to 139 according to specified criteria. The output units 130 to 137 for example can be configured as a spiral slot stacker which stacks the bank notes or separator cards to be stored in trays 131, 133, 135, 137 by means of rotating units 130, 132, 134, 136 having spiral slots. In addition, a shredder 138 can be present, e.g. in order to destroy bank notes 139 no longer fit for circulation.

Bank notes recognized by sensor device 112 and control device 140 are stored in the output units 130 to 139 corresponding to the specified criteria in dependence on the result of the check. For example, bank notes in good state (bank notes fit for circulation) can be stored in the tray 133, while bank notes in poor state (bank notes no longer fit for circulation) in the tray 135. Selectively, bank notes in poor state can also be destroyed by means of the shredder 138.

Information items about number, type (denomination and currency) of the recognized bank notes are captured by the control device 140, stored and assigned to the information items characterizing the respective accounting unit. In this way the recognized bank notes can be accounted for the respective accounting unit, i.e. the corresponding number of bank notes and their type or a total value resulting therefrom is credited to the respective accounting unit.

Bank notes which upon checking cannot be recognized by the sensor device 112 and the control device 140, are divided into two groups by the control device 140. The first group comprises the non-recognized bank notes whose serial number can be read by means of the sensor device 112 and the control device 140. The second group of non-recognized bank notes contains the remaining non-recognized bank notes, that is the bank notes whose serial number cannot be ascertained by the sensor device 112 and the control device 140, or bank notes which in a double or multiple pick are singled. Bank notes of the first group can be stored for example in the tray 137, while bank notes of the second group are stored in the tray 131.

Figure 2:
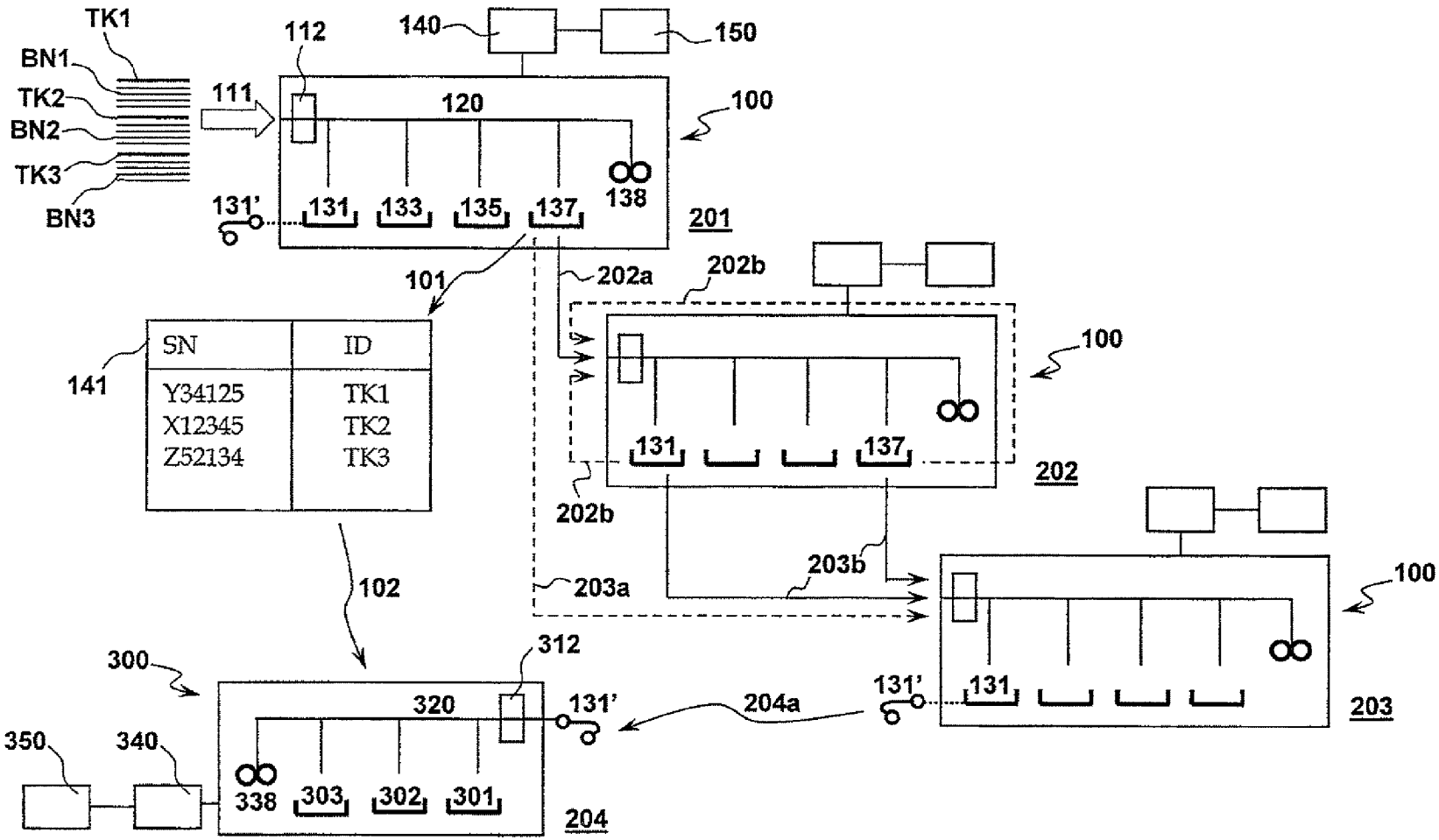
FIG. 2 shows the processing of bank notes by means of processing machines for several accounting units in several processing steps.

In FIG. 2 there is represented the processing of several bank notes BN1 to BN3 of different accounting units. In the represented example, the various accounting units are separated by means of separator cards TK1 to TK3. The separator cards TK1 to TK3 have the information items described above which make possible an unequivocal characterizing of the respective accounting unit, for example, an unequivocal identification or an account number.

In a first processing step 201, the accounting units, consisting of separator cards TK1 to TK3 and bank notes BN1 to BN3, are processed with the processing machine 100—as described above. For this purpose, they are singled 111, individually transported 120, checked by sensor device 112 and control device 140, and stored 131 to 137 corresponding to the result of the check or destroyed 138. For example, bank notes in good state are stored in the tray 133, while bank notes in poor state are stored in the tray 135 or are destroyed by shredder 138.

Non-recognized bank notes of the first group, i.e. bank notes whose respective serial number could be read, are stored in the tray 137, while non-recognized bank notes of the second group, i.e. bank notes whose respective serial number could not be read, are stored in the tray 131.

Into the tray 131 there can also be transported the separator cards of the accounting units. Thus, it is later possible for the bank notes of the second group to be assigned to their respective accounting unit by means of the separator cards.

Alternatively or additionally to the separation of the bank notes of the second group according to their accounting units by means of the separator cards, the bank notes of the second group of the respective accounting units can also be assigned by the bank notes being transported into an output unit 131' which has a plurality of pockets, whereby bank notes of the second group of each accounting unit—and if desired together with the respective separator card—are inserted into one of the pockets. The control device 140 then allocates to the pockets, which can be numbered or coded, the information items of the respective accounting unit from which the bank notes of the second group come. Likewise, each bank note of the second group can be individually inserted into a pocket or be individually wound onto a coil. In this case, to each pocket or to each position of the coil there is allocated by the control device 140 the information about the respective accounting unit from which the bank note of the second group comes.

The serial numbers SN of the bank notes of the first group captured by the sensor device 112 and control device 140 are stored 101 in the processing machine 100. For this purpose, there can be created for example a table 141 and stored in a memory of the control device 140. To the respective serial number SN there is assigned information ID and stored together with the serial number SN, which makes possible the assignment of the serial number SN and thus of the corresponding bank note to the accounting unit from which the respective bank note comes. The information ID can be for example the above described unequivocal identification of the separator card TK1 to TK3. Thus, for example, the bank note with the serial number Y34125 can be assigned to the first accounting unit, since the unequivocal identification of the separator card TK1 has been assigned to it. The information ID can alternatively or additionally consist of the number or coding of the pocket of the output unit 131'.

For the recognized bank notes of the respective accounting unit there can be effected an accounting, i.e. to the respective accounting unit are credited the associated bank notes corresponding to the recognized currency and denomination. Additionally or alternatively, a total value for the respective accounting unit can be ascertained. The accounting data can be stored for example in the above-described memory of the control device 140. Moreover, to the respective accounting unit there are assigned those bank notes which were assigned to the first group. For this, for example the above-described table 141 can be used. In cases in which the accounting units consist of bank notes of a certain, single currency and denomination, a provisional accounting for the respective accounting unit can be performed. If, for example, three bank notes of an accounting unit, which is to consist exclusively of 50 Euro bank notes, were assigned to the first group, the total value of the recognized bank notes is increased by Euro 150. This is possible, because the three non-recognized bank notes of the first group of all probability are 50 Euro bank notes, since the accounting unit, as assumed, is to consist only of 50 Euro bank notes.

If the bank notes of the second group were stored in the first tray 131, at the end of the first processing step 201 these will be removed, for a later post-processing, from the tray 131 together with the separator cards separating them. If the above-described output unit 131' was used for storing the bank notes of the second group, the output unit 131' makes available the next free pocket.

Thereafter, the bank notes of the first group are removed from the tray 137 and a second processing step 202 can be carried out by means of the processing machine 100. Carrying out the second processing step serves the target of reducing the number of the bank notes contained in the first group. Often, bank notes which upon the processing with the processing machine could not be unequivocally recognized, can be recognized upon a new processing.

This for example can be due to the fact that the bank note was transported obliquely during the first processing, so that the unequivocal recognition was not possible. It can also be due to the fact that upon the first processing the bank note was inserted in a wrong position (orientation).

In the second processing step 202, the bank notes of the first group are inserted 202*a* into the input tray and processed anew in the manner described above. Upon a new processing, the bank notes of the first group are again captured by the sensor device 112 and judged by the control device 140. In principle, the second processing step 202 can have all above-described results for the processed bank notes.

The bank notes processed anew can be recognized, i.e. at least their type can be ascertained by sensor device 112 and control device 140. Such bank notes can be—as described in the first processing step 201—stored in the trays 133 or 135 or be destroyed by shredder 138. On the basis of the respectively recognized serial number and the assignment via the table 141 there can moreover be performed a final accounting for recognized bank notes, in which the recognized bank note is credited to the respectively assigned accounting unit. The total value of this accounting unit is changed corresponding to the currency and denomination of the recognized bank note. After the final accounting the corresponding serial number SN and the assigned identification ID can be deleted from the table 141.

In the second processing step 202 one can do without the use of the serial numbers. Recognized, authentic bank notes are stored in the output units 133 or 133 or are destroyed by shredder 138. Since the recognized, authentic bank notes were already provisionally accounted before, a new acknowledgement or correction of the provisional accounting is not required. Non-recognized bank notes are stored in the output units 131 or 137 and are further processed. Only in the later explained fourth processing step 204, in which the provisional assignment or accounting is corrected when required, the serial numbers are to be taken into account again.

It may also happen upon the second processing step 202, that bank notes again cannot be recognized. In a similar way as described before for the first processing step 201, it may happen here that from some bank notes there can be read at least the serial number. The non-recognized bank notes can then be stored for example in the tray 131, whereas the non-recognized bank notes whose serial number was recognized can be stored in the tray 137. However, in the second processing step 202 it is also possible to store all non-recognized bank notes in a common tray, since the serial numbers of all bank notes processed in the second processing step 202 were already ascertained in the first processing step 201 and stored in the table 141.

For further reducing the bank notes of the first group, the second processing step 202 can be repeated several times. For this purpose, the bank notes are removed from the trays 131 and 137 and again inserted 202*b* into the processing machine 100.

Likewise, it is also possible to do without a second processing step 202. In this case, after the first processing step 201 described above there directly follows a third processing step 203 described below.

For the third processing step 203 the bank notes of the first group are removed 203*a* (without second processing step 202) or the remaining bank notes of the first group are removed 203*b* (one or more second processing steps 202) and inserted anew into the processing machine 100. The bank notes are singled and transported into the output unit 131'. As in the first processing step 201, the bank notes which are recognized in the third processing step 203 can be stored in the output units 133 or 135 or be destroyed by shredder 138. In the output unit 131' all bank notes of the first group can be jointly stored in one pocket, i.e. a separation according to the accounting units is not necessary, since the corresponding information about the serial number of the respective bank note can be made available by means of the table 141. If the output unit 131' is not used, the bank notes of the first group can be stored in one of the trays, for example in tray 131. In this case, the third processing step with the processing machine 100 may also be omitted and the bank notes of the first group are directly supplied to a post-processing in a fourth processing step 204. In this case, for the fourth processing step 204 also the bank notes of the second group together with the separator cards TK1 to TK3 dividing them are supplied by the operator.

Upon the post-processing in the fourth processing step 204 there can be employed a processing machine 300 for the post-processing. This machine has a structure of substantially the same kind as the processing machine 100 having a sensor device 312, a transport system 320, trays 301, 302 and 303, a shredder 338, a control device 340 and an input/output unit 350.

For carrying out the fourth processing step 204, the bank notes of the first group contained in the output unit 131' are outputted from the output unit 131', removed and inserted into the processing machine 300 for the post-processing and singled by it. Likewise, it can be provided that the output unit 131' is connected to the processing machine 300 for the post-processing, so that the bank notes of the first group are automatically removed and singled.

Upon the processing of the bank notes of the first group in the processing machine 300 for the post-processing, a repeated check of the bank notes is carried out by means of sensor device 312 and control device 340. Bank notes which are recognized (as authentic), can be stored for example in the tray 301 or are destroyed 338. Non-recognized bank notes can be stored in the tray 302. Forgeries or bank notes suspected to be forgeries can be stored in the tray 303. The processing machine 300 also stores in the tray 303 bank notes which were recognized as authentic but for whose face value (denomination) there was ascertained a value which deviates from the value recognized in previous processing steps and considered in the provisional accounting.

For the fourth processing step in addition the table 141 is transferred 102 from the processing machine 100 to the processing machine 300 for the post-processing, for example via a data line or a wired or wireless network. By means of the assignment of the serial numbers SN to the identifications ID of the accounting units in the table 141, currency and value (i.e. denomination or face value) of the recognized bank notes can be accounted for the respective accounting units.

Also the fourth step 204 for the bank notes of the first group can be repeated once or several times, in order to reduce the number of bank notes not recognized or mistakenly classified to be a suspected forgery.

For the final accounting of the bank notes of the first group, the bank notes stored in the trays 302 (non-recognized bank notes) and 303 (forged bank notes and bank notes suspected to be forgeries and bank notes of deviating face value) are removed and judged by the operator. If the operator can assign to the respective bank note a currency and a denomination and if the operator considers the bank note to be authentic, the bank note is accounted for the associated accounting unit. For this purpose, for example the serial numbers of the not yet accounted bank notes from the table 141 can be shown on the display unit 350. By means of the serial number of the respective bank notes the operator can select and assign the matching serial number on the output unit 350, for example by entering the corresponding serial number by means of a keyboard of the input unit 350. The selection and assignment however can also be effected by means of a graphical surface and a mouse or touchscreen. The bank note is then accounted for the respective accounting unit through the information contained in the table 141. Likewise, a final assignment is effected for bank notes which cannot be recognized by the operator or which are forged or suspected to be forgeries. Here, additional information items can be assigned, i.e., that it is a forgery.

If—as described above by way of example—only bank notes of the same currency and denomination were processed, the final accounting by the operator is facilitated, since in this case a change of the accounting is not necessary, if the operator recognizes the bank notes of the first group and judges them to be authentic. A change of the accounting is only necessary, if the operator judges bank notes to be forged or to be suspected forgeries, or if bank notes with deviating currency and/or denomination are present.

In a corresponding manner, the bank notes of the second group are processed with the processing machine 300 for the post-processing in the fourth step. For the bank notes of the second group, however, attention has to be paid to the fact that each of the accounting units is processed and accounted separately, since for the individual bank notes of the second group no assignment to the accounting units was ascertained. This assignment is only present through the separator cards TK1 to TK3 used for separation, or through the information items in the output device 131', e.g. the assignment of a certain pocket of the output device 131' to a certain accounting unit. Thus, the processing of the fourth processing step 204 described above for the first group of bank notes, for the bank notes of the second group is carried out separately for each of the accounting units. For this purpose, the operator can process for example the bank notes of the second group of an accounting unit which is delineated, through the associated separator card from the other accounting units. E.g., the bank notes of the second group of the first accounting unit are delineated from other bank notes through the separator cards TK1 and TK2. Due to the present order, the operator can also recognize that the separator, card TK1 is the associated first accounting unit for which the bank notes must be accounted. The information of the separator card TK1 can be entered by the operator by means of the input unit 350 or also be captured by the sensor device 312. Then the final accounting of the bank notes of the second group of the first accounting unit is effected in the manner described for the bank notes of the first group. Only after the accounting of all bank notes of the second group of the first accounting unit, the fourth processing step is carried out also for the bank notes of the second group of the second accounting unit. After that for the bank notes of the second group of the third accounting unit etc.

If the above-described output unit 131' is used for the bank notes of the first and the second group, some processing rules have to be observed in order to avoid accounting errors. It is a matter of course that the output unit 131' must be replaced when its intake capacity is exhausted. In this case, a further, empty output unit 131' must be used for the further processing. Likewise, the output unit 131' must be removed after the end of a processing shift, i.e. when the operator changes. If the above-described processing variant is used, in which only bank notes of a certain currency and denomination are processed, the output device 131' must also be replaced by a further, empty output device 131', if bank notes of a deviating currency and/or denomination are to be processed. With each replacement of the output device 131' it is necessary that at least the third processing step 203, if desired the second processing step 202 beforehand, is carried out so that all bank notes of the first group of the accounting units just processed, whose bank notes of the second group are already in the output device 131', are also contained in the output device 131'.

It is obvious that for an unequivocal assignment of the output units 131' the output units 131', too, must have an unequivocal characterization, so that the bank notes of the various accounting units contained therein can be assigned and accounted by the control device 140 or 340. The corresponding information can be stored for example in the table 141.

For the above-described processing of bank notes with four processing steps 201 to 204 there are used two processing machines 100 and 300. It is obvious, however, that all processing steps can also be carried out by means of one single processing machine. It is also obvious that more than two processing machines can be used.

The previous description was based on the assumption that of bank notes assigned to the first group at least the serial number can be captured and recognized. In principle, also other individual and unequivocal identification features of the bank notes can be used. Such an identification feature can be for example an individual deviation of the bank notes, as it may arise for example upon manufacturing. For example, the printed image of a bank note can have individual deviations which can be used as identification features. These deviations in the printed image can arise for example from a shifting of the printed image in relation to the margin of the bank note or through deviations due to different printing processes (offset printing, die stamping etc). Such an identification feature, as the serial number, can also be ascertained by sensor device 112 and control device 140.

In the following description of the basic sequence of processing with the help of FIGS. 3 and 4, the order of the described steps does not necessarily relate to the temporal sequence upon processing the accounting units and the bank notes contained therein in the processing machine or the processing machines. Many of the described steps in the processing by the processing machine or processing machines are instead carried out simultaneously or in a different order. To facilitate understanding, however, an order of steps is described in which first the processing of recognized bank notes is effected, then the processing of bank notes which cannot be recognized (second group) and finally the processing of the bank notes whose serial number could have been recognized (first group).

Figure 3:
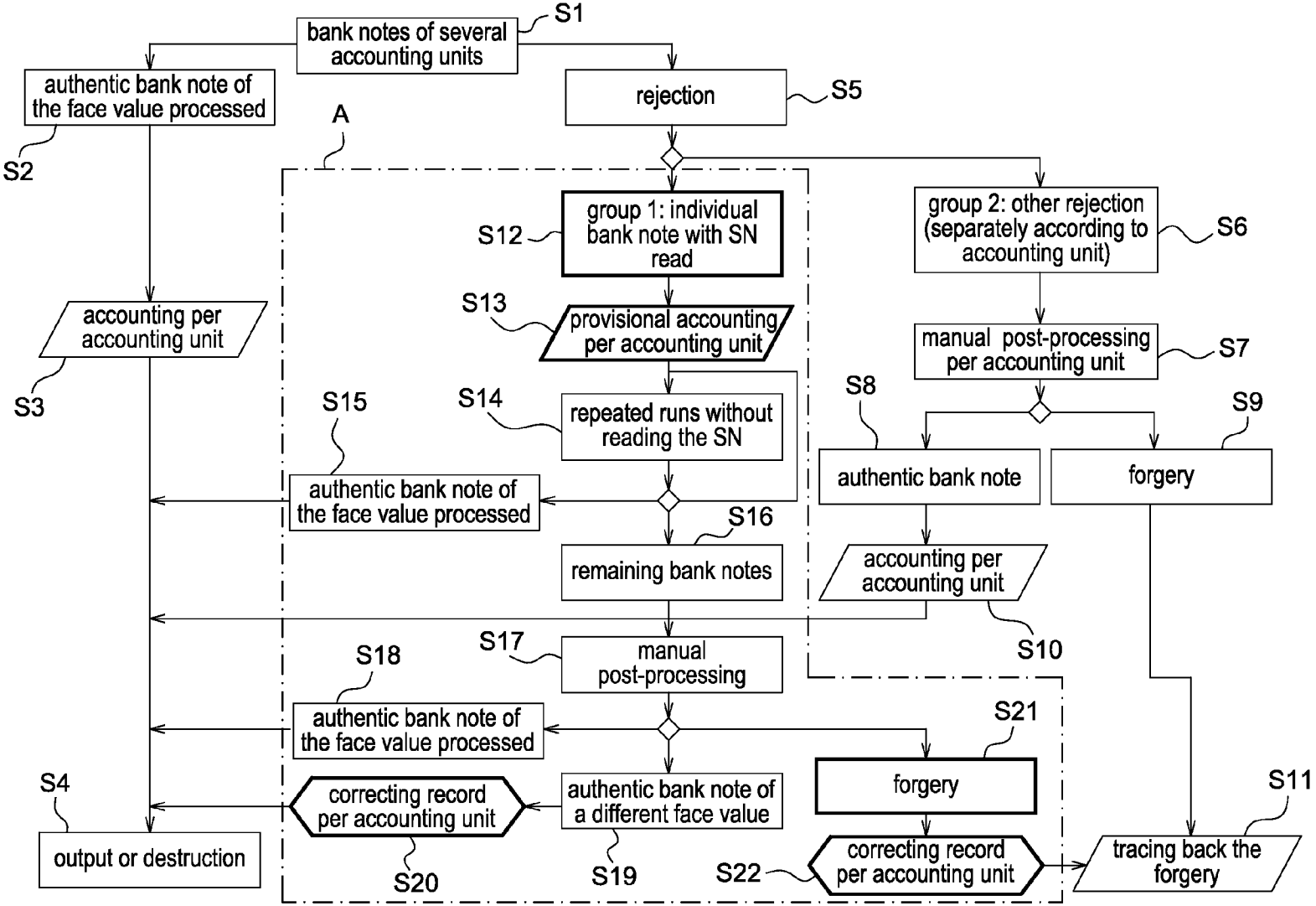
FIG. 3 shows a basic sequence of the processing of several accounting units which consist of bank notes of a specified currency and face value.

FIG. 3 shows a basic sequence of the processing of several accounting units which consist of bank notes of a specified currency and face value (denomination).

In the first step S1, several accounting units are successively processed such that the bank notes can be assigned to their respective accounting unit. For this purpose, there are used for example, as described above, separator cards etc. By way of example, all bank notes are to belong to the currency Euro and have the face value 50.

In a second step S2, bank notes recognized, upon the check in the processing machine, as authentic and Euro 50 by sensor device and control unit are separated, and credited to the associated accounting unit in a third step S3. Then (step S4) these bank notes are outputted to be further used or destroyed (output units 133, 135 or shredder 138). If for an exemplary accounting unit eight bank notes were recognized (step S2), to this exemplary accounting unit a value of Euro 400 is credited (step S3).

In a fifth step S5, the non-recognized bank notes are rejected. Here, bank notes whose serial numbers could not be recognized, in a sixth step S6 are separated according to accounting units, e.g. by means of the pockets of the above-described output unit 131'.

Upon the post-processing of the bank notes of the second group in the seventh step S7, the bank notes of the second group are divided into authentic bank notes (eighth step S8) and forgeries (ninth step S9).

Every authentic bank note is credited to the respective accounting unit in a tenth step S10, i.e. the value of the accounting unit is increased by 50. If the authentic bank note has a currency and/or face value not corresponding to the processed one (here: Euro 50), to the respective accounting unit will be credited a corresponding value. The bank notes are supplied to output or destruction (step S4).

In an eleventh step S11, forgeries can be traced back with the help of the information items (depositor, account number, etc) on which the respective accounting unit is based, in order to determine from whom the forgery comes.

In a twelfth step S12, bank notes which in the fifth step. S5 were rejected as non-recognized bank notes are assigned to the respective accounting unit with the help of the recognized serial numbers.

In a thirteenth step 13, a provisional accounting is effected, i.e. to the respective accounting unit there is credited a value of Euro 50 for each bank note of the first group, since only 50 Euro bank notes are to be processed.

In a fourteenth step S14, the remaining bank notes of the first group can be post-processed as often as desired with the processing machine, whereby a new reading of the serial numbers can be omitted, as these have already been previously ascertained for the bank notes of the first group. As in the thirteenth step S13, recognized bank notes are credited to the respective accounting unit.

Authentic bank notes of the processed currency and face value (Euro 50) of the steps S13 and S14, in a fifteenth step S15 are supplied to output or destruction (step S4).

The remaining bank notes are collected in a sixteenth step S16 and supplied to a manual post-processing in a seventeenth step S17. As described above, the manual post-processing can be effected solely by an operator, but there can also be used a particular processing machine 300. Bank notes which here are recognized as authentic and belonging to the processed currency and face value, can be supplied to output or destruction (step S4) in an eighteenth step S18. As these bank notes have already been provisionally accounted in the thirteenth step S13, no further correction is necessary.

In a nineteenth step S19 authentic bank notes of a different currency and/or face value are recognized. Since for these bank notes in the provisional accounting in the thirteenth step S13 there has been assumed and provisionally accounted so far the specified value (Euro 50), a corresponding correction must be effected in a twentieth step S20. If it is e.g. a 100 Euro bank note, the value of the associated accounting unit has to be increased by 50, since Euro 50 were provisionally (step S13) accounted. Then, the bank notes are outputted or destroyed (step 4).

Bank notes which upon the manual post-processing in the seventeenth step S17 turn out to be forgeries, in a twenty-first step S21 are classified as forgeries. Since these bank notes were provisionally accounted as Euro 50 (step 13), in a twenty-second step S22 there is effected a correction, i.e. the value of the corresponding accounting unit must be reduced by 50.

The steps S12 to S22 demarcated with the dashed line A form the essential steps of the invention for the processing of non-recognized bank notes of the first group. In steps with bold boundary lines (steps S12, S13, S20, S21, S22) the use of the ascertained serial number is required and essential for assigning and accounting the bank notes to the respectively associated accounting unit.

Figure 4:
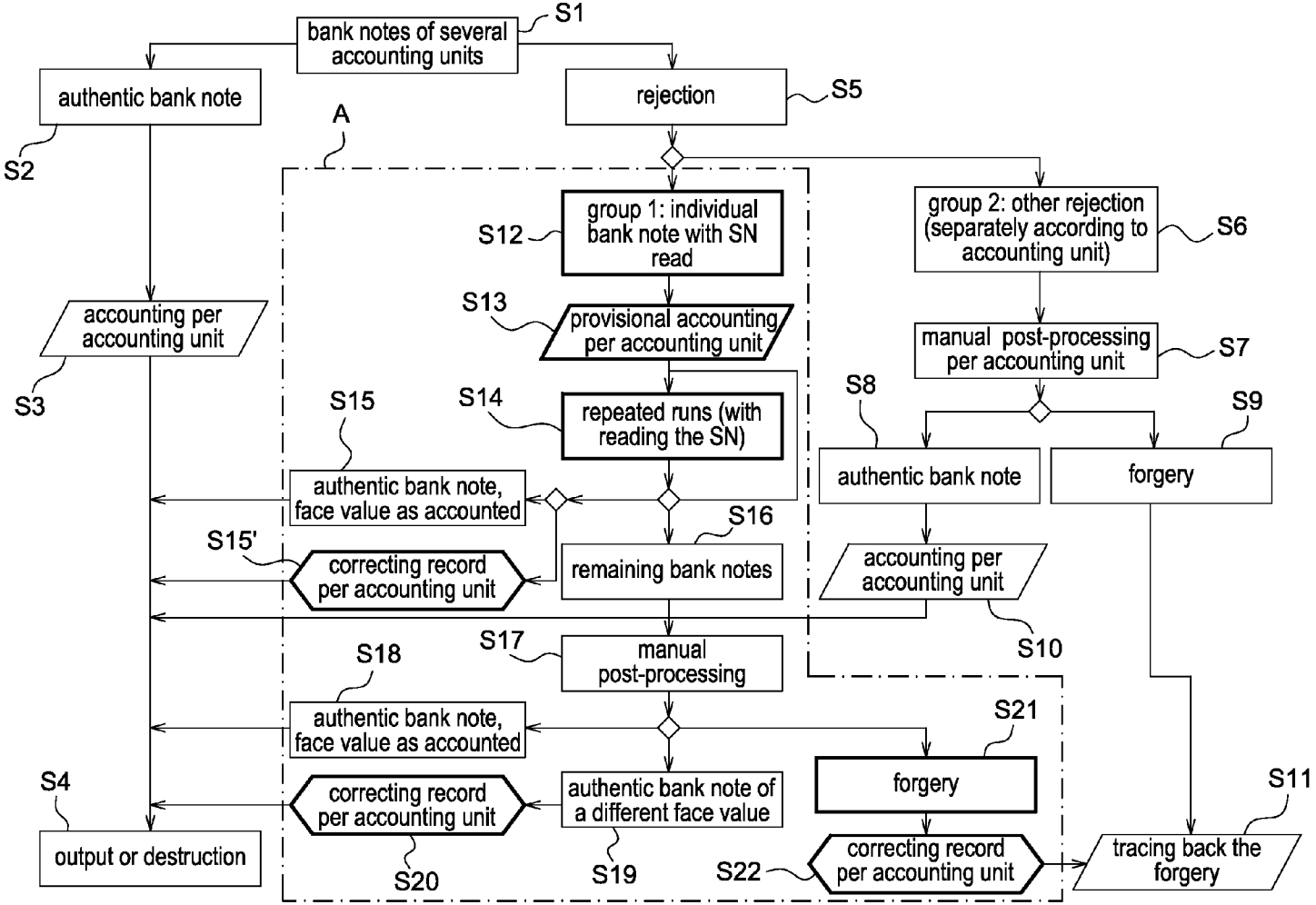
FIG. 4 shows a basic sequence of the processing of several accounting units which consist of any bank notes.

FIG. 4 shows a basic sequence of the processing of several accounting units which consist of any bank notes, i.e. no certain face value (denomination) and or currency is specified.

The processing of bank notes with currency and face value not specified, according to FIG. 4, substantially corresponds to the processing of bank notes with specified currency and face value according to FIG. 3. For each of the bank notes of the first group, however, there is provisionally assumed a denomination or face value and currency. If the face value and denomination cannot be unequivocally determined by sensor device 112 and control device 140, for the further processing there can be used e.g. a face value and denomination for the provisional accounting which is ascertained by the control device 140 to be the most likely currency and face value.

In contrast to the sequence in FIG. 3, according to FIG. 4, however, also in the repeated runs after the fourteenth step 14 it is necessary to ascertain the serial numbers of the bank notes, so that it is possible to assign the bank note respectively recognized in a repeated run to the associated accounting unit (representation of step S14 with bold boundary line). So as to make possible the correction of a face value ascertained to be diverting and/or a currency ascertained to be diverting upon a repeated run (step S14), a step 15' complementary to the fifteenth step S15 is additionally necessary. In the complementary step 15' the assumed and provisionally accounted currency and/or face value is corrected. If for example for a bank note with a certain serial number the currency Euro and the face value 50 (step S12) was assumed and provisionally accounted for the associated accounting unit (step S13), and if in a repeated run (step S14) it is determined that the bank note with the certain serial number actually has the currency Euro and the face value 100, then the provisionally ascertained value of the associated accounting unit is to be increased by 50. For this purpose, in the complementary step 15' there can be entered for example the actual currency and/or the actual face value. Whereupon the control device 140 corrects the value for the associated accounting unit.

The invention claimed is:

1. A method for processing bank notes in which accounting units comprising one or several bank notes are successively processed by a processing machine, wherein the bank notes are checked by a sensor device and a control device, comprising the steps:

inserting one or more accounting units, entering information items characterizing the accounting units, singling the bank notes of each accounting unit, checking the individual bank notes, and assigning and transporting the individual bank notes to output units of the processing machine, in dependence on the check, accounting bank notes which are recognized upon the check for the respective accounting unit by the control device and transporting the recognized bank notes into the assigned output unit, dividing bank notes which are not recognized upon the check into two groups by the control device, so that a first group of said groups contains the non-recognized individual bank notes for which an identification feature characterizing the respective bank note can be ascertained by sensor device and control device, and the second group of said groups contains the non-recognized bank notes whose respective identification feature cannot be ascertained by the sensor device and the control device, separating out bank notes of the first and second group, and assigning, via the control device the ascertained identification features of the bank notes of the first group to the respective accounting unit.

2. The method according to claim 1, wherein all bank notes of the accounting units to be processed belong to a specified currency and one denomination, including the steps of provisionally accounting bank notes of the first group with this currency and denomination for the respective accounting unit by the control device.

3. The method according to claim 1, including provisionally accounting all bank notes of the first group with the ascertained currency and denomination for the respective accounting unit by the control device.

4. The method according to claim 1, including storing the banknotes of the second group separately according to accounting units, so that there are assigned to the bank notes of the second group separated from each other according to accounting units the information items characterizing the respective accounting unit.

5. The method according to claim 4, including checking the bank notes of the second group by an operator and/or the processing machine or a further processing machine and accounting for the respective accounting unit in dependence on the check by means of the assigned characteristic information items.

6. The method according to claim 1, including, after the processing of the accounting units, processing the bank notes of the first group again by the processing machine, so that bank notes which are recognized upon the check are accounted by the control device for the assigned accounting unit and are transported into the assigned output unit, and bank notes which are not recognized upon the check are transported into the output units of the first or second group, so that the assignment of the identification features of the bank notes of the first group to the respective accounting units is maintained.

7. The method according to claim 6, including processing the non-recognized bank notes at least one further time by the processing machine.

8. The method according to any of claim 1, including checking by an operator the bank notes of the first group and/or the processing machine or a further processing machine and accounting for the respective accounting unit in dependence on the check by means of the characteristic information items assigned to the respective identification feature by the control device.

9. The method according to claim 8, wherein a change of the accounting is only effected if the respective bank note does not belong to a specified or previously ascertained currency and denomination.

10. The method according to claim 1, including forming the identification feature by the serial number of the respective bank note.

11. A system comprising a processing machine or several processing machines arranged to carry out the method according to claim 1.

* * * * *